US009013466B2

(12) United States Patent
Chien et al.

(10) Patent No.: US 9,013,466 B2
(45) Date of Patent: Apr. 21, 2015

(54) ORGANIC LIGHT EMITTING DIODE DISPLAY DEVICE AND DRIVING METHOD THEREOF

(71) Applicant: AU Optronics Corp., Hsin-Chu (TW)

(72) Inventors: Yi-Ting Chien, Hsin-Chu (TW); Tsang-Hong Wang, Hsin-Chu (TW); Yi-Yo Dai, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 107 days.

(21) Appl. No.: 13/798,184

(22) Filed: Mar. 13, 2013

(65) Prior Publication Data

US 2014/0204069 A1 Jul. 24, 2014

(30) Foreign Application Priority Data

Jan. 22, 2013 (TW) ..... 102102316 A

(51) Int. Cl.
*G09G 3/32* (2006.01)

(52) U.S. Cl.
CPC ..... *G09G 3/3291* (2013.01); *G09G 3/3258* (2013.01); *G09G 2330/021* (2013.01)

(58) Field of Classification Search
None
See application file for complete search history.

(56) References Cited

U.S. PATENT DOCUMENTS 7,595,596 B2 9/2009 Liu
7,663,589 B2 * 2/2010 Ha et al. ..... 345/92
2004/0113906 A1 6/2004 Lew
2004/0233125 A1 11/2004 Tanghe
2005/0093788 A1 * 5/2005 Shin ..... 345/76
2005/0168417 A1 * 8/2005 Ha et al. ..... 345/76
2005/0219166 A1 * 10/2005 Kim ..... 345/76
2006/0145961 A1 * 7/2006 Hu ..... 345/76
2007/0018916 A1 * 1/2007 Kim et al. ..... 345/76
2007/0040772 A1 * 2/2007 Kim ..... 345/76
2008/0001857 A1 * 1/2008 Yoo ..... 345/76
2008/0012811 A1 * 1/2008 Sung et al. ..... 345/89
2008/0100609 A1 * 5/2008 Lee et al. ..... 345/212
2008/0169772 A1 7/2008 Liu
2010/0033475 A1 * 2/2010 Choi et al. ..... 345/214
2011/0090213 A1 * 4/2011 Han ..... 345/213
2011/0115832 A1 * 5/2011 Lee et al. ..... 345/690
2011/0164071 A1 * 7/2011 Chung et al. ..... 345/690
2011/0187697 A1 * 8/2011 Yun et al. ..... 345/212
2013/0321479 A1 * 12/2013 Ka ..... 345/690
2014/0204069 A1 * 7/2014 Chien et al. ..... 345/212

FOREIGN PATENT DOCUMENTS

TW 200830257 7/2008

* cited by examiner

*Primary Examiner* — Peter Vincent Agustin
(74) *Attorney, Agent, or Firm* — Winston Hsu; Scott Margo

(57) ABSTRACT

An organic light emitting diode (OLED) display device includes a plurality of OLED pixels, a gate driver, a source driver, and a voltage controller. Each of the OLED pixels includes a current control switch and an OLED. A first end of the current control switch is coupled to a first voltage source. A first end of the OLED is coupled to a second end of the current control switch, and a second end of the OLED is coupled to a second voltage source. The gate driver is configured to output scan signals to sequentially turn on the plurality of OLED pixels. The source driver is configured to output display voltages to the plurality of OLED pixels. The voltage controller is configured to adjust a voltage difference between the first voltage source and the second voltage source according to a maximum grey level value of display data of a frame.

18 Claims, 5 Drawing Sheets

ORGANIC LIGHT EMITTING DIODE DISPLAY DEVICE AND DRIVING METHOD THEREOF

BACKGROUND

1. Technical Field

The disclosure relates to an organic light emitting diode display device, and more particularly, to an organic light emitting diode display device capable of reducing power consumption.

2. Description of the Prior Art

An organic light emitting diode (OLED) display device is a display device driving OLED pixels to emit light for displaying images. Brightness of an OLED is proportional to a level of a current flowing through the OLED. Generally, the OLED pixel comprises a current control switch configured to control the level of the current flowing through the OLED according to a display voltage applied at a gate end of the current control switch, for further controlling the brightness of the OLED.

However, the current control switch may consume part of power. And when the current is larger, the current control switch consumes more power. The OLED display device of the prior art can not effectively reduce power consumption of the current control switch.

SUMMARY

The disclosure provides an organic light emitting diode (OLED) display device, which comprises a plurality of OLED pixels, a gate driver, a source driver, and a voltage controller. Each of the OLED pixels includes a current control switch and an OLED. A first end of the current control switch is coupled to a first voltage source. A first end of the OLED is coupled to a second end of the current control switch, and a second end of the OLED is coupled to a second voltage source. The gate driver is configured to output scan signals to sequentially turn on the plurality of OLED pixels. The source driver is configured to output display voltages to the plurality of OLED pixels. The voltage controller is configured to adjust a voltage difference between the first voltage source and the second voltage source according to a maximum grey level value of display data of a frame.

The disclosure further provides a driving method of an organic light emitting diode (OLED) display device, which comprises providing an OLED display device, the OLED display device comprising a plurality of OLED pixels, each of the OLED pixels comprising a current control switch and an OLED, a first end of the current control switch being coupled to a first voltage source, a first end of the OLED being coupled to a second end of the current control switch, a second end of the OLED being coupled to a second voltage source; outputting scan signals according to display data of a frame for sequentially turning on the plurality of OLED pixels; adjusting a voltage difference between the first voltage source and the second voltage source according to a maximum grey level value of display data of the frame; and outputting display voltages to the plurality of OLED pixels according to the voltage difference between the first voltage source and the second voltage source.

According to the embodiments of the OLED display device and the driving method, the present invention can dynamically adjust the voltage difference between the first voltage source and the second voltage source according to the maximum grey level value of display data of each frame during the corresponding frame displaying period, in order to reduce power consumption of the current control switch. Therefore, the OLED display device of the present invention is capable of saving more power.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
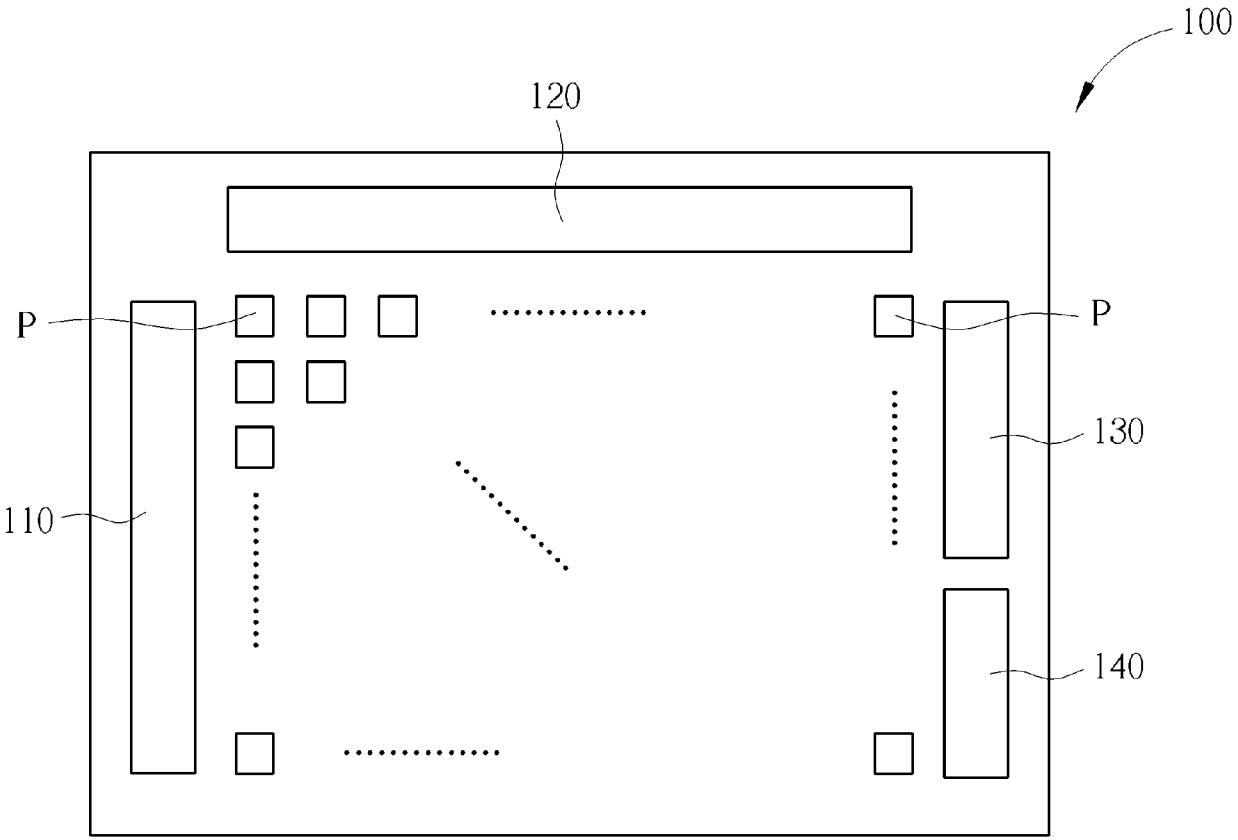
FIG. 1 is a diagram showing an organic light emitting diode (OLED) display device of the present invention.
Figure 2:
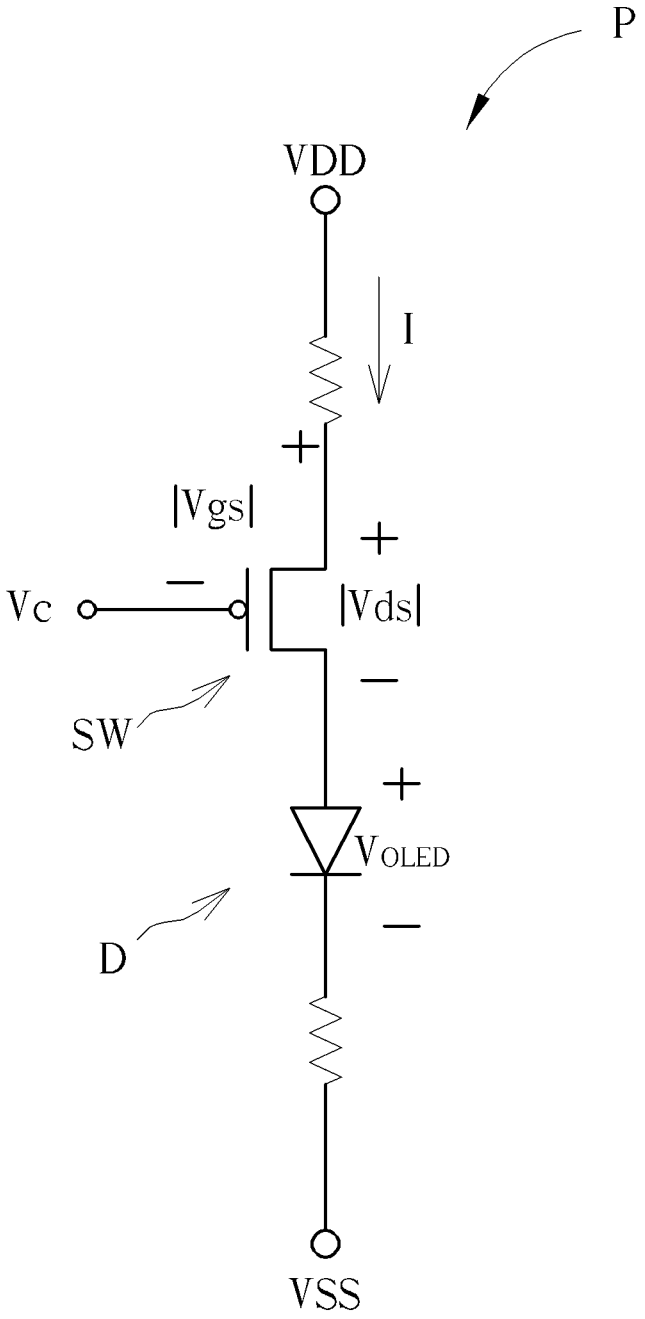
FIG. 2 is a diagram showing an equivalent circuit of an OLED pixel.

Please refer to FIG. 1 and FIG. 2 together. FIG. 1 is a diagram showing an organic light emitting diode (OLED) display device of the present invention. FIG. 2 is a diagram showing an equivalent circuit of an OLED pixel. As shown in figures, the OLED display device 100 comprises a plurality of OLED pixels P, a gate driver 110, a source driver 120, and a voltage controller 130. Each of the OLED pixels P includes a current control switch SW and an organic light emitting diode D. A first end of the current control switch SW is coupled to a first voltage source VDD. A first end of the organic light emitting diode D is coupled to a second end of the current control switch SW, and a second end of the organic light emitting diode D is coupled to a second voltage source VSS. The gate driver 110 is configured to output scan signals to sequentially turn on the plurality of OLED pixels P. The source driver 120 is configured to output display voltages Vc to the plurality of OLED pixels according to display data of a frame, in order to control the OLED pixels P to display images. The voltage controller 130 is configured to adjust a voltage difference between the first voltage source VDD and the second voltage source VSS according to a maximum grey level value of display data of the frame.

Figure 3:
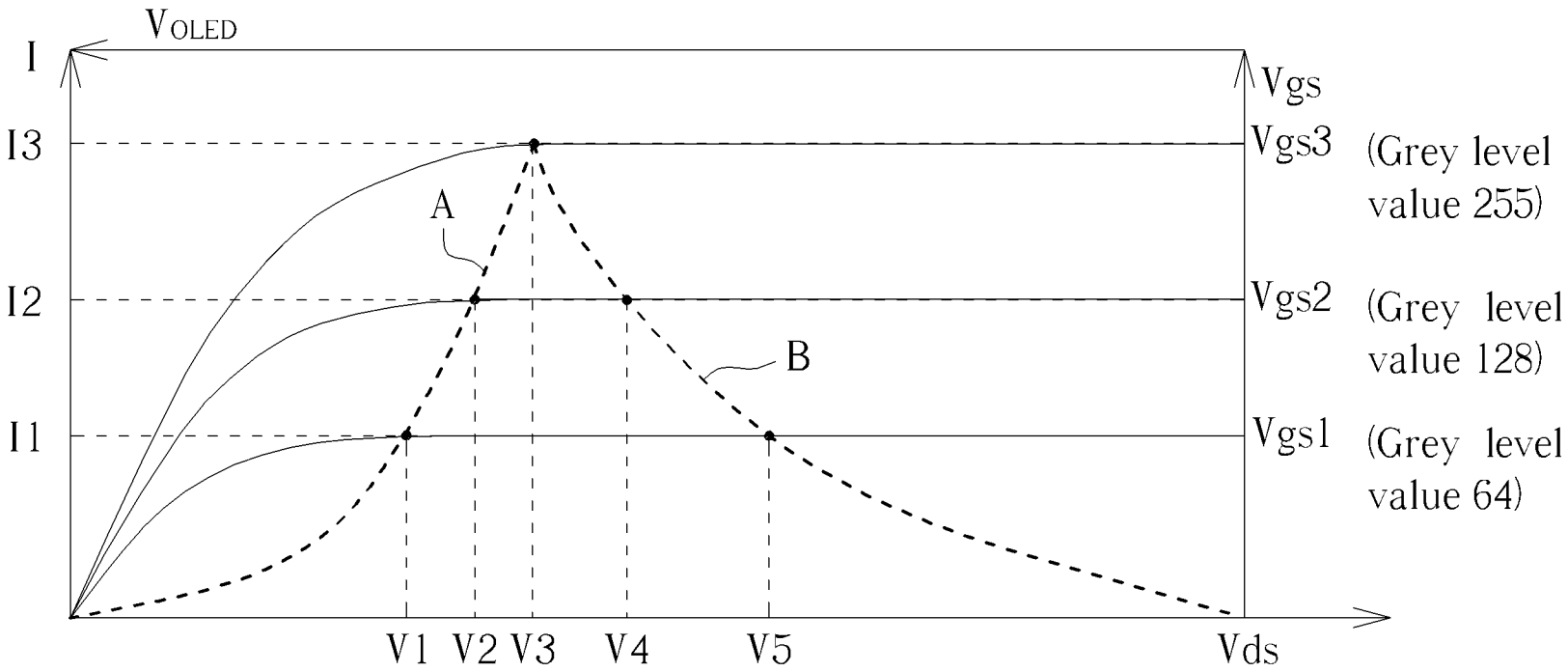
FIG. 3 is a diagram showing characteristic curves of the OLED pixel.

Please refer to FIG. 3, and refer to FIG. 1 and FIG. 2 as well. FIG. 3 is a diagram showing characteristic curves of the OLED pixel. As shown in FIG. 3, curve A is a saturation curve. Left side of the curve A is a liner region, and right side of the curve A is a saturation region. Curve B is a voltage curve of the organic light emitting diode D representing a voltage difference $V_{OLED}$ between two ends of the organic light emitting diode D. A maximum level of a current I flowing through the organic light emitting diode D is determined by a voltage difference Vgs between a gate end and a source end of the current control switch SW. When the voltage difference Vgs is fixed, and a voltage difference Vds between two ends of the current control switch SW is located in the saturation region, the current I flowing through the current control switch SW is kept at corresponding maximum level I1, I2, I3 without being increased. Since summation of the voltage difference Vds and the voltage difference $V_{OLED}$ between two ends of the organic light emitting diode D is approximately equal to a voltage difference between the first voltage source VDD and the second voltage source VSS (VDD−VSS), and the voltage difference $V_{OLED}$ between two ends of the organic light emitting diode D is constant when the current I is fixed, thus when a grey level value of the OLED pixel P is substantially smaller than a grey level limit value, the voltage difference Vds is generally located at the right side of the curve A. If the voltage difference (VDD−VSS) between the first voltage source VDD and the second voltage source VSS can be reduced to move the voltage difference Vds to be located on the curve A, brightness of the OLED pixel P still can be kept the same when the voltage difference Vds is reduced, that is to say power consumption of the current switch SW is reduced.

For example, in the present embodiment, the grey level limit value (the largest grey level value) of the OLED pixels P is 255, wherein the displaying range of the grey level of the OLED pixels P are 8 bits. When the maximum grey level value of display data of a frame is 255, the voltage difference Vgs is fixed at Vgs3, and the voltage difference Vds is V3 then. Since the voltage difference Vds is located on the curve A, the voltage difference Vds can not be further reduced, otherwise the brightness of the OLED pixel P is changed. When the maximum grey level value of display data of a frame is 128, the voltage difference Vgs is fixed at Vgs2, and the voltage difference Vds is V4 then. In order to reduce the voltage difference Vds for moving the voltage difference Vds to be located on the curve A, the voltage controller 130 can decrease a voltage level of the first voltage source VDD or increase a voltage level of the second voltage source VSS, for reducing the voltage difference (VDD−VSS) between the first voltage source VDD and the second voltage source VSS, and further reducing the voltage difference Vds from V4 to V2, such that the brightness of the OLED pixel P still can be kept the same when the power consumption of the current switch SW is reduced. When the maximum grey level value of display data of a frame is 64, the voltage difference Vgs is fixed at Vgs1, and the voltage difference Vds is V5 then. In order to reduce the voltage difference Vds for moving the voltage difference Vds to be located on the curve A, the voltage controller 130 can decrease the voltage level of the first voltage source VDD or increase the voltage level of the second voltage source VSS, for reducing the voltage difference (VDD−VSS) between the first voltage source VDD and the second voltage source VSS, and further reducing the voltage difference Vds from V5 to V1, such that the brightness of the OLED pixel P still can be kept the same when the power consumption of the current switch SW is reduced.

When the maximum grey level value of display data of the frame is substantially smaller, the voltage difference Vds can be reduced more, and the power consumption of the current switch SW is also reduced more correspondingly.

In addition, the level of the current I is approximately equal to square of a voltage difference (VDD−Vc) between the first voltage source VDD and the display voltage Vc. In order to avoid affecting the current I when decreasing the voltage level of the first voltage source VDD, when the voltage controller 130 decreases the voltage level of the first voltage source VDD, the source driver 120 must correspondingly decrease voltage levels of the display voltages Vc according to a voltage decreasing level of the first voltage source VDD, so as to keep the voltage difference (VDD−Vc) between the first voltage source VDD and the display voltage Vc unchanged.

In the above embodiment, the current control switch SW is a P-type transistor. However, in other embodiments of the present invention, the current control switch SW can be an N-type transistor. When the current control switch SW is a P-type transistor, increasing the voltage level of the second voltage source VSS can achieve better performance; and when the current control switch SW is an N-type transistor, decreasing the voltage level of the first voltage source VDD can achieve better performance.

Figure 4:
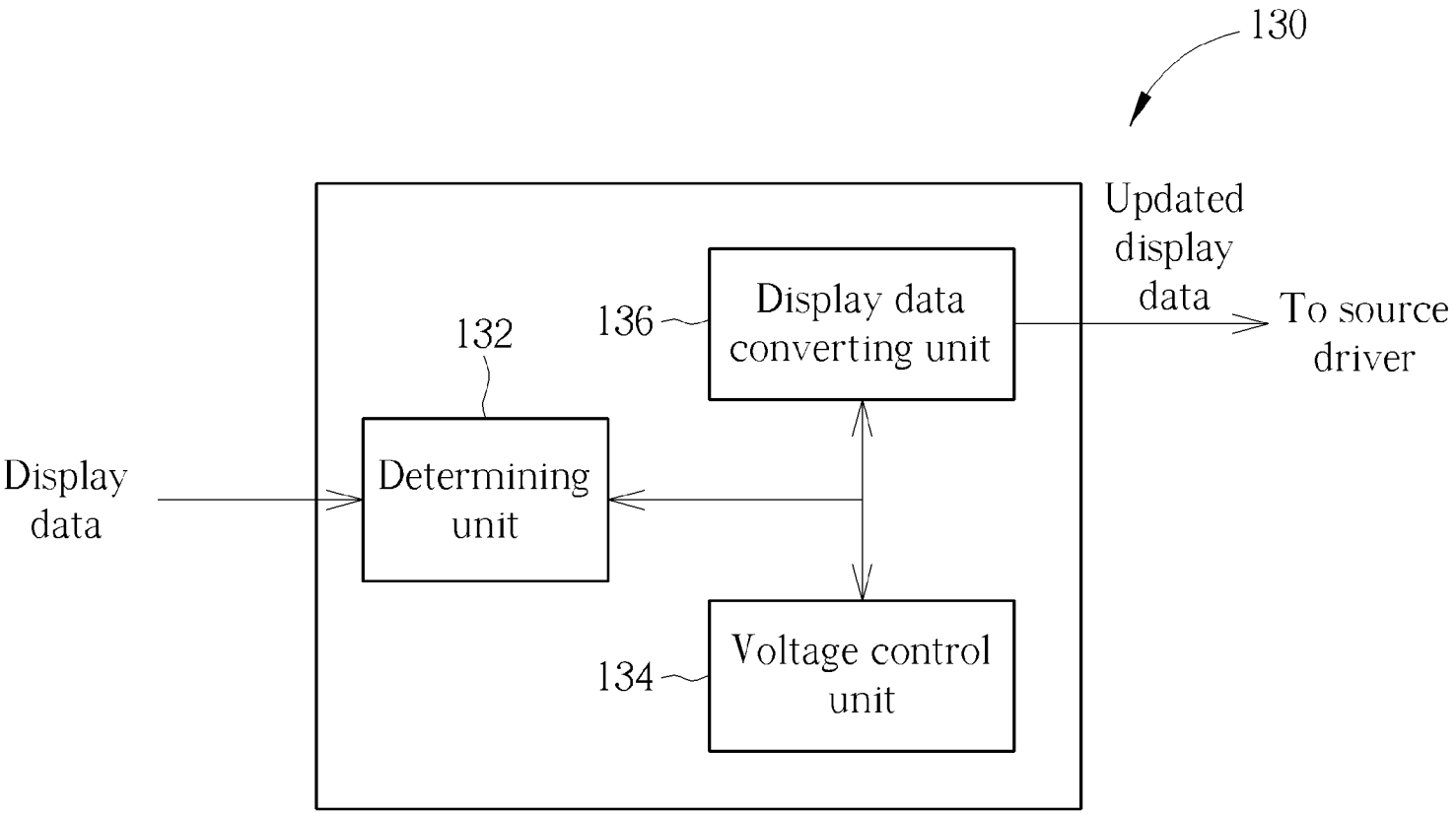
FIG. 4 is a functional block diagram of the voltage controller of the present invention.

Please refer to FIG. 4. FIG. 4 is a functional block diagram of the voltage controller 130 of the present invention. As shown in FIG. 4, the voltage controller 130 of the present invention comprises a determining unit 132 and a voltage control unit 134. The determining unit 132 is configured to receive display data of each frame, and determine the maximum grey level value of display data of the frame. The voltage control unit 134 is configured to adjust the voltage difference (VDD−VSS) between the first voltage source VDD and the second voltage source VSS during a corresponding frame displaying period according to the maximum grey level value determined by the determining unit 132, such as decreasing the voltage level of the first voltage source VDD, or increasing the voltage level of the second voltage source VSS. The voltage controller 130 can further comprise a display data converting unit 136. When the voltage control unit 134 decreases the voltage level of the first voltage source VDD, the display data converting unit 136 can correspondingly adjust the display data and transmit to the source driver 120, such that the source driver 120 can drive the OLED pixels P by updated display voltages Vc, in order to avoid affecting the current I when decreasing the voltage level of the first voltage source VDD.

In addition, the OLED display device 100 can further comprise a memory 140 configured to store a lookup table. The voltage controller 134 can adjust the voltage difference (VDD−VSS) between the first voltage source VDD and the second voltage source VSS according to the maximum grey level value determined by the determining unit 132 and the lookup table.

Figure 5:
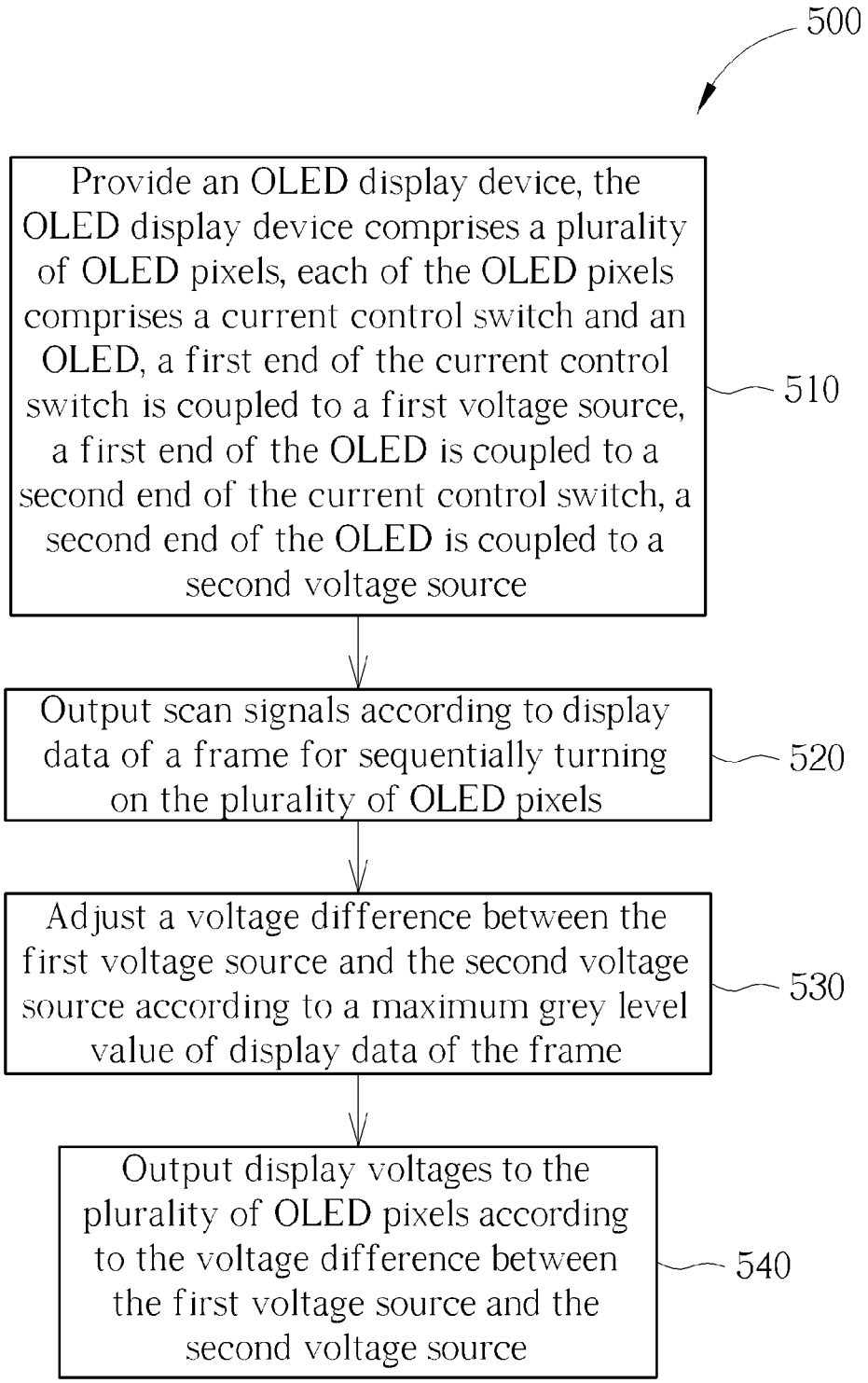
FIG. 5 is a flowchart showing the driving method of the OLED display device of the present invention.

Please refer to FIG. 5. FIG. 5 is a flowchart 500 showing the driving method of the OLED display device of the present invention. The flowchart of driving method of the OLED display device of the present invention comprises the following steps:

Step 510: Provide an OLED display device, the OLED display device comprises a plurality of OLED pixels, each of the OLED pixels comprises a current control switch and an OLED, a first end of the current control switch is coupled to a first voltage source, a first end of the OLED is coupled to a second end of the current control switch, a second end of the OLED is coupled to a second voltage source;

Step 520: Output scan signals according to display data of a frame for sequentially turning on the plurality of OLED pixels;

Step 530: Adjust a voltage difference between the first voltage source and the second voltage source according to a maximum grey level value of display data of the frame; and Step 540: Output display voltages to the plurality of OLED pixels according to the voltage difference between the first voltage source and the second voltage source.

In contrast to the prior art, the OLED display device of the present invention can dynamically adjust the voltage difference between the first voltage source and the second voltage source according to the maximum grey level value of display data of each frame during the corresponding frame displaying period, in order to reduce power consumption of the current control switch. Therefore, the OLED display device of the present invention is capable of saving more power.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An organic light emitting diode (OLED) display device, comprising:

a plurality of OLED pixels, each of the OLED pixels comprising:

a current control switch with a first end coupled to a first voltage source; and an OLED with a first end coupled to a second end of the current control switch, and a second end coupled to a second voltage source;

a gate driver configured to output scan signals to sequentially turn on the plurality of OLED pixels;

a source driver configured to output display voltages to the plurality of OLED pixels; and a voltage controller configured to adjust a voltage difference between the first voltage source and the second voltage source according to a maximum grey level value of display data of a frame in order to reduce a voltage difference between the first end and the second end of the current control switch to a minimum value of a saturation region of the current control switch.

2. The OLED display device of claim 1, wherein the voltage controller decrease the voltage difference between the first voltage source and the second voltage source when the maximum grey level value of display data of the frame is substantially smaller than a grey level limit value.

3. The OLED display device of claim 2, wherein the voltage controller decrease a voltage level of the first voltage source when the maximum grey level value of display data of the frame is substantially smaller than the grey level limit value.

4. The OLED display device of claim 3, wherein the grey level limit value is the largest grey level value of each of the OLED pixels.

5. The OLED display device of claim 2, wherein the voltage controller increase a voltage level of the second voltage source when the maximum grey level value of display data of the frame is substantially smaller than the grey level limit value.

6. The OLED display device of claim 5, wherein the grey level limit value is the largest grey level value of each of the OLED pixels.

7. The OLED display device of claim 1 further comprises a memory configured to store a lookup table, wherein the voltage controller is configured to adjust the voltage difference between the first voltage source and the second voltage source according to the maximum grey level value of display data of the frame and the lookup table.

8. A driving method of an organic light emitting diode (OLED) display device, comprising:

providing an OLED display device, the OLED display device comprising a plurality of OLED pixels, each of the OLED pixels comprising a current control switch and an OLED, a first end of the current control switch being coupled to a first voltage source, a first end of the OLED being coupled to a second end of the current control switch, a second end of the OLED being coupled to a second voltage source;

outputting scan signals according to display data of a frame for sequentially turning on the plurality of OLED pixels;

adjusting a voltage difference between the first voltage source and the second voltage source according to a maximum grey level value of the display data of the frame in order to reduce a voltage difference between the first end and the second end of the current control switch to a minimum value of a saturation region of the current control switch; and outputting display voltages to the plurality of OLED pixels according to the voltage difference between the first voltage source and the second voltage source.

9. The driving method of claim 8, wherein adjusting the voltage difference between the first voltage source and the second voltage source according to the maximum grey level value of display data of the frame comprises:

decreasing the voltage difference between the first voltage source and the second voltage source when the maximum grey level value of display data of the frame is substantially smaller than a grey level limit value.

10. The driving method of claim 9, wherein decreasing the voltage difference between the first voltage source and the second voltage source is decreasing a voltage level of the first voltage source.

11. The OLED display device of claim 10, wherein the grey level limit value is the largest grey level value of each of the OLED pixels.

12. The driving method of claim 9 further comprises adjusting the display voltages according to a voltage decreasing level of the first voltage source.

13. The driving method of claim 9 further comprises decreasing the display voltages according to a voltage decreasing level of the first voltage source.

14. The driving method of claim 9, wherein decreasing the voltage difference between the first voltage source and the second voltage source is increasing a voltage level of the second voltage source.

15. The OLED display device of claim 14, wherein the grey level limit value is the largest grey level value of each of the OLED pixels.

16. The driving method of claim 8, wherein adjusting the voltage difference between the first voltage source and the second voltage source according to the maximum grey level value of display data of the frame is adjusting the voltage difference between the first voltage source and the second voltage source according to the maximum grey level value of display data of the frame and a lookup table.

17. An organic light emitting diode (OLED) display device, comprising:

a plurality of OLED pixels, each of the OLED pixels comprising:

a current control switch with a first end coupled to a first voltage source; and an OLED with a first end coupled to a second end of the current control switch, and a second end coupled to a second voltage source;

a gate driver configured to output scan signals to sequentially turn on the plurality of OLED pixels;

a source driver configured to output display voltages to the plurality of OLED pixels; and a voltage controller configured to adjust a voltage difference between the first voltage source and the second voltage source according to a maximum grey level value of display data of a frame;

wherein the voltage controller comprises a display data converting unit configured to correspondingly adjust the display data when the voltage controller decreases a voltage level of the first voltage source, and the source driver updates the display voltages according to the adjusted display data.

18. A driving method of an organic light emitting diode (OLED) display device, comprising:

providing an OLED display device, the OLED display device comprising a plurality of OLED pixels, each of the OLED pixels comprising a current control switch and an OLED, a first end of the current control switch being coupled to a first voltage source, a first end of the OLED being coupled to a second end of the current control switch, a second end of the OLED being coupled to a second voltage source;

outputting scan signals according to display data of a frame for sequentially turning on the plurality of OLED pixels;

adjusting a voltage difference between the first voltage source and the second voltage source according to a maximum grey level value of the display data of the frame;

correspondingly adjusting the display data when a voltage level of the first voltage source is decreased; and updating display voltages according to the adjusted display data and outputting the updated display voltages to the plurality of OLED pixels.

* * * * *